US008584393B2

(12) United States Patent
McCrimmon, Jr. et al.

(10) Patent No.: US 8,584,393 B2
(45) Date of Patent: Nov. 19, 2013

(54) ACCESSORY BRACKET FOR FIREARM MOUNT

(75) Inventors: Thomas Warren McCrimmon, Jr., Lebanon, TN (US); Mark Edward Hagedorn, Hendersonville, TN (US); Joseph LaDon Bebee, Gallatin, TN (US)

(73) Assignee: Laser Devices, Inc., Monterey, CA (US)

( * ) Notice: Subject to any disclaimer, the term of this patent is extended or adjusted under 35 U.S.C. 154(b) by 204 days.

(21) Appl. No.: 13/182,392

(22) Filed: Jul. 13, 2011

(65) Prior Publication Data

US 2013/0014419 A1 Jan. 17, 2013

(51) Int. Cl.
*F41G 3/06* (2006.01)

(52) U.S. Cl.
USPC ..... 42/115; 89/37.03

(58) Field of Classification Search
USPC ..... 42/71.01, 72, 115; 89/37.03, 37.12
See application file for complete search history.

(56) References Cited

U.S. PATENT DOCUMENTS

| | | | | |
|---|---|---|---|---|
| 7,520,083 | B2 | 4/2009 | Dextraze | |
| 7,823,316 | B2 | 11/2010 | Storch et al. | |
| 7,870,689 | B2 | 1/2011 | Dextraze | |
| 8,316,574 | B1 * | 11/2012 | Swan | 42/146 |
| 2010/0269392 | A1 * | 10/2010 | Swan | 42/71.01 |
| 2011/0061281 | A1 * | 3/2011 | Kapusta et al. | 42/71.01 |

* cited by examiner

*Primary Examiner* — Stephen M Johnson
(74) *Attorney, Agent, or Firm* — K&L Gates LLP

(57) ABSTRACT

An accessory bracket 100 comprising first element 200 and second element 300 along with means for attaching first element with a firearm mount 10 and second element. The second element provides a semi-cylindrical accessory bar 320 with a length to safely extend the accessories such that the accessories do not interfere with operator vision or full movement or deflection of firearms. When attaching the second element with the first element, the accessory bracket provides an upper and lower position for adjusting the height of the second element in relation to the first element, the firearm mount, and the firearm 20. Safe, interchangeability for multiple firearms and accessories are provided as well as access areas and apertures for attaching the first and second elements, changing a barrel, wiring and connectors for accessories, as well as for firearm cooling and dispersal of gas and debris from the firearm rounds of ammunitions.

12 Claims, 12 Drawing Sheets

ACCESSORY BRACKET FOR FIREARM MOUNT

FIELD OF INVENTION

The present invention relates to the general field of firearms. It is specifically related to systems for mounting various accessories to firearms.

BACKGROUND OF INVENTION

It is well known to use various accessories such as infrared lasers, night vision optics and flood lights with firearms. In the case of small to large firearms the accessories may be securely mounted directly with the firearm or to an accessory bracket mounted directly with the firearm weapon. Small arms are known for the direct mounting configuration. The larger firearms such as the M2HB Machine Gun or the MK19 Grenade Launcher that produce much higher loads of recoil should be mounted with a weapon mount. Various accessories typically are mounted with the small firearm directly or in some cases the various accessories are mounted with an accessory rail or bracket that is directly mounted with the firearm. The larger machine gun firearm is normally placed into a machine gun mount for firing. Relocation of the various accessories may be required in order to maximize the operator's vision down the front of the large or small firearm. One example of a cradle mount is the MK Ranger, which adapts to the MK64 and MK93 Machine Gun Mounts and can be used for both the M2HB Machine Gun and MK19 Grenade Launcher, and receives a laser as an accessory. A disadvantage of such mounts is that it is not compatible with the current armor configurations and will not allow full movement of the firearm through the armor shield due to the accessory and armor restricting firearm movement. Without full firearm deflection, the ability of the operator to use the device is greatly reduced by not being able to direct the weapon as desired to neutralize enemy attacks at the limits of deflection.

Accordingly, there exists a need for an accessory mount that can accept up to three accessory devices, and mount directly to the weapon mount configuration, so that multiple firearms can be independently interchanged in the same configuration of firearm mount and accessories without removing the laser or light devices. There also exists a need for attaching the accessories well forward of the armor in order to allow for maximum operator visibility and to enable lasers to align for accurate firing and for full movement and deflection of the firearm while not hindering the operation of the firearm or minimizing the restriction of movement of the firearm utilized in the mounting configuration especially with armor shields. Further, there exists a need for easily adjustable accessory mounts directly secured to the firearm mount. In addition, there exists a need for safety devices that cannot be removed and for accessory mounts that are interchangeable with many firearms.

SUMMARY

The present invention provides a means for attaching an accessory bracket and accessories with the firearm mount wherein the means for attaching the accessory bracket further provides a means for adjusting the height of the accessory bracket in relation to the firearm mount, or the firearm and allows for independent interchange of multiple types of firearms. The accessory bracket provides a means for extension of the accessories for operator vision and full vertical movement of the firearm with firearm mount and armor shield independent of the length of the firearm; provides a means for safety when a firearm barrel or muzzle flash are shorter than the length of the accessory bracket; and provides a means for barrel change out without removal of the firearm or the accessory bracket from the firearm mount.

It is therefore an aim of the present invention to provide an accessory mount that is secured directly to the machine gun or firearm mount that will enable multiple firearms interchangeability and one to three accessory items for each firearm configuration.

It is another aim of the present invention to provide an accessory mount that accurately adjusts position and securely attaches without hindering firearm configurations.

It is a further aim of the present invention to provide an accessory mount that enables at least seven different firearms to be used interchangeably without modification of the firearm, weapon mount, or accessory bracket.

Therefore, in accordance with the present invention, there is provided an accessory mount for securing one to three accessories to the bracket, without compromise to the firearms or the weapon mount. The first element of the accessory mount is connected directly to the front of the weapon mount and the second element of the accessory mount is directly connected with the first element of the accessory mount. The second element of the accessory mount is adjustable and removable to accommodate the firearms installation or installation of firearm direct accessories. The second element has non-removable safety devices in order to minimize risk to the operator during firing operations. The second element of the accessory mount has design features that accommodate the larger firearms quick change barrel system without modification or change to the firearm or accessory mount. Also in accordance with the present invention, there is provided an accessory mount for use with current armor configurations in the field. The second element of the accessory mount extends well beyond the opening of the armor, which enables one to three accessory items to be mounted without modification of the firearm or the weapon mount. The accessory mount may provide electrical cables routing and relief to eliminate cable damage and to minimize the risk of electrical shock to the operator.

BRIEF DESCRIPTION OF THE DRAWINGS

These and other features, aspects, and advantages of the invention will become better understood with regard to the following description, appended claims, and accompanying drawings where:

DETAILED DESCRIPTION OF THE INVENTION

Figure 1:
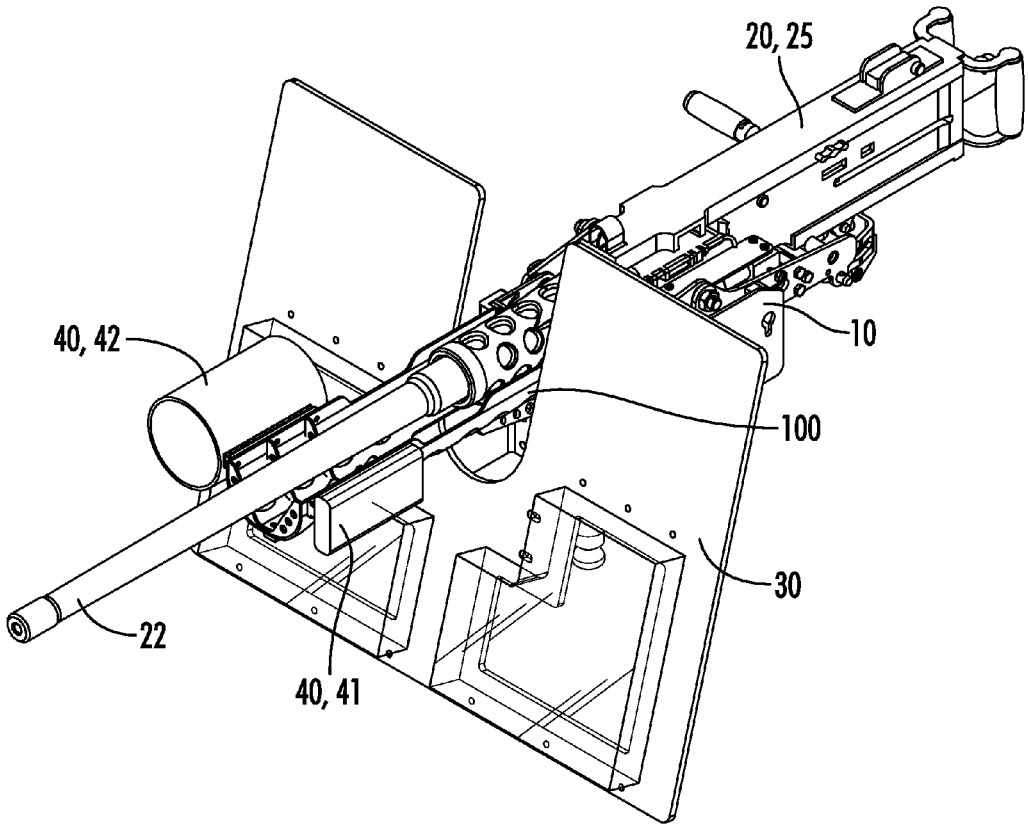
FIG. 1 is a perspective view of one embodiment of an accessory mount with a firearm mount, a firearm, accessories, and an armor shield.

The present invention relates to the general field of firearms. More specifically systems for mounting various accessories to firearms. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

Overview:

The function and utility of an accessory bracket is to attach the accessory bracket with a firearm mount or gun mount such as a MK-93 Gun Mount that receives multiple firearms including but not limited to heavy M2HB Machine Gun or MK19 Grenade Launcher; medium M240 B, C, G, or H Machine Gun, MAG58 Machine Gun, PKM Machine Gun, and MK48 Machine Gun; and light M249 SAW and Minimi Machine Gun, and provides a means for mounting accessories including but not limited to MIL Spec lasers spotters 41, MIL Spec flood lights 42, Bore Sighting Equipment, and Fire Control Systems. The accessory bracket provides a platform for independently changing firearms or for independently changing accessories while the accessory bracket may remain secured to the firearm mount. As illustrated in FIGS. 1 through 19, an accessory bracket 100 is combined with a firearm mount 10. In addition, the firearm mount 10 may be attached with a firearm 20, and an armor shield 30 may be attached with the firearm mount 10. The accessory bracket 100 comprises a first element 200 that attaches with the firearm mount 10 and a second element 300 that attaches with the first element 200 wherein accessories 40 may be attached with the second element 300. The first element 200 comprises a means for attaching the first element 200 with the firearm mount 10 and a means for attaching the first element 200 with the second element 300. The second element 300 comprises a means for attaching the second element 300 with the first element 200 and a means for attaching an accessory 40 with the second element 300. The second element 300 comprises a semi-cylindrical accessory bar 320 with a length to safely extend the accessories 40 such that the accessories 40 do not interfere with the operator's vision nor interfere with the full movement or deflection of the firearm 20. When attaching the second element 300 with the first element 200 the accessory bracket 100 provides an upper position and a lower position for adjusting a height of the second element 300 in relation to the first element 200, the firearm mount 10, the firearm 20, and the armor shield 30. Access areas and apertures are provided for attaching the first element, the second element, changing a barrel, changing wiring and connectors for accessories, and working with the firearms and ammunition as well as for firearm cooling and dispersal of gas and debris from the firearm rounds of ammunitions. It will be apparent that a number of safety features have been incorporated.

Design Specifications:

First Element 200:

The main support or first element 200 comprises a means for attaching with the firearm mount 210 and a means for attaching with the second element 220. One embodiment of a structure of the first element 200 may comprise a rear base plate 230, a right and left side plate 240, 241, a front mount plate 250, a right and left lower side gusset 260, 261, a right and left upper front gusset 262, 263. The rear base plate 230 may include two shock bolt apertures 232 for mounting the first element 200 with a firearm mount 10. The preferred shock bolt aperture 232 accommodates .500 shock bolts used with the MK93 machine gun mount. The rear base plate 230 may further include a horizontal slotted aperture 234 for allowing the MK 93 gun mount catch bag assembly to slide into the horizontal slotted aperture 234 and a radius cutout 236 for clearance for the different firearm 20 installations. The right side plate 240 may include an arc cutout 244, 245 at a top rear portion of the right and left side plate 240, 241 for hooking over a firearm mount alignment bolt 12, a side dowel aperture 246 for a dowel 268, 269, and a side access aperture 242. The left side plate 241 is the mirror of the right side plate 240. The front mount plate 250 may include two front mount plate apertures 252 and the two front mount plate apertures 252 may each further include a nut 391 attached or welded with the front mount plate 250, an upper semi-circular cutout 254 for providing clearance for the firearm 20 installation, and a lower semi-circular cutout 255 opening for wires and connectors to pass through. The front mount plate 250 may have a .375-16 nut 391 welded with the front mount plate 250 as a preferred embodiment. The rear base plate 230 is attached with the right and the left side plates 240, 241, and the right and the left side plates 240, 241 are attached with the front mount plate 250. The right and left lower side gusset 260, 261, are attached with the rear base plate 230, the right or left side plates 240, 241 respectively and the front mount plate 250. The right and left upper front gusset 262, 263 are attached with the right and left side plate 240, 241 respectively and the front mount plate 250. The right and left dowel 268, 269 may be inserted in the right side dowel aperture 246 and the left side dowel aperture 247 with the right and left dowel 268, 269 approximately flush with the inside of the right and left side plates 240, 241 and the right and left dowel 268, 269 extending out of the right and left dowel apertures 246, 247 on the outside of the first element 200 for providing an attaching point with the second element 300. The side access apertures 242, 243 on each side of the first element 200 provide access to the first element 200, the firearm mount 10, and the firearm 20 areas for access including but not limited to mounting and removing the first element 200 with the firearm mount 10. In addition, top and bottom access apertures 270, 280 are provided for access to the first element 200, the firearm mount 10, and the firearm 20 areas. Shock bolts such as .500-13 bolts may be used with the first element rear base plate 230 and the rear plate shock bolt apertures 232 for securing the first element 200 with the firearm mount 10.

Second Element 300:

The second element 300 comprises a means for attaching with the first element 310 wherein the second element means for attaching with the first element 200 further comprises a means for adjusting the height 315 of the second element 300 in relation to the first element 200, the firearm mount 10, the firearm 20 and the armor shield 30, when attaching the second element 300 with the first element 200. The second element 300 provides a means for attaching the accessories 40 and a means for extension of the accessories 40 for operator vision and full vertical movement of the firearm 20 with firearm mount 10 and armor shield 30 independent of the length of the firearm barrel 22. The second element 300 provides a means for safety when the firearm barrel 22 and muzzle flash 24 are shorter than the length of the second element 300. The second element 300 provides a means for barrel change without removal of the firearm 20 or the accessory bracket 100 from the firearm mount 10.

Figure 2:
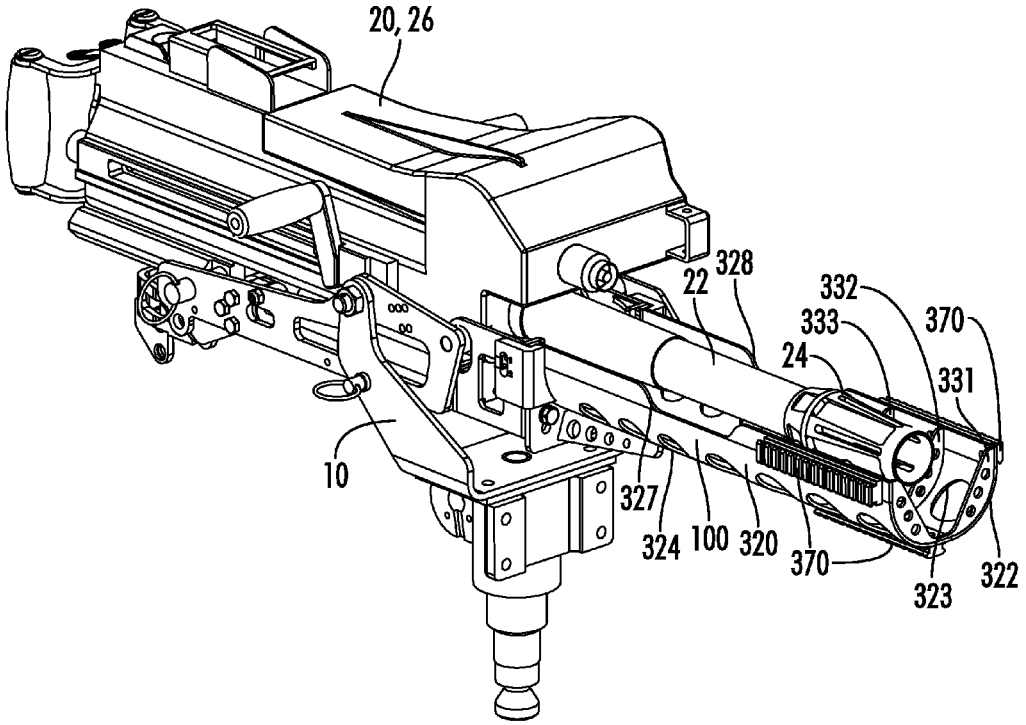
FIG. 2 is a perspective view of another embodiment of an accessory mount with a firearm mount, and a firearm.
Figure 3:
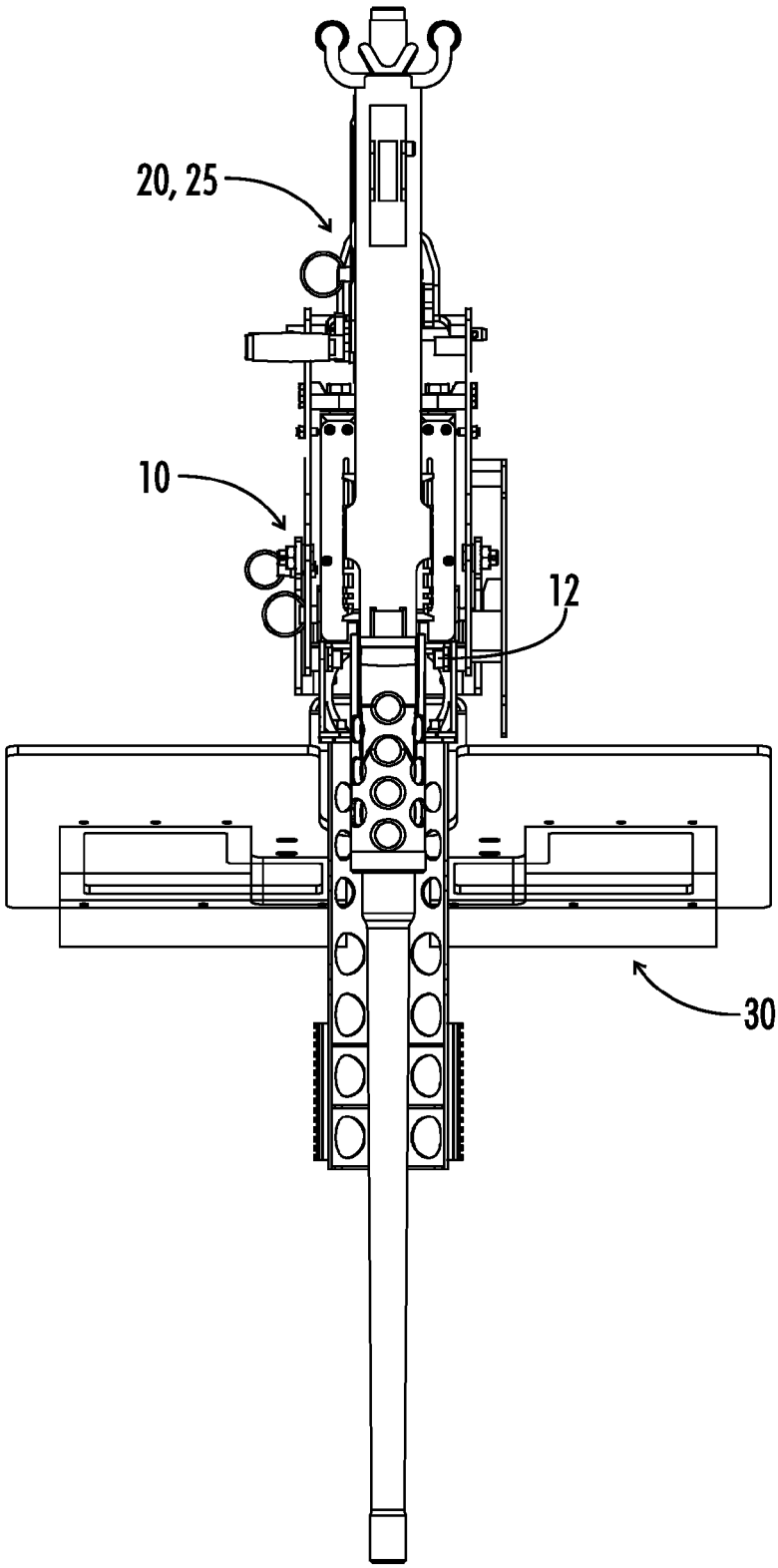
FIG. 3 is a top view of one embodiment of an accessory mount with a firearm mount, a firearm, and an armor shield.
Figure 4:
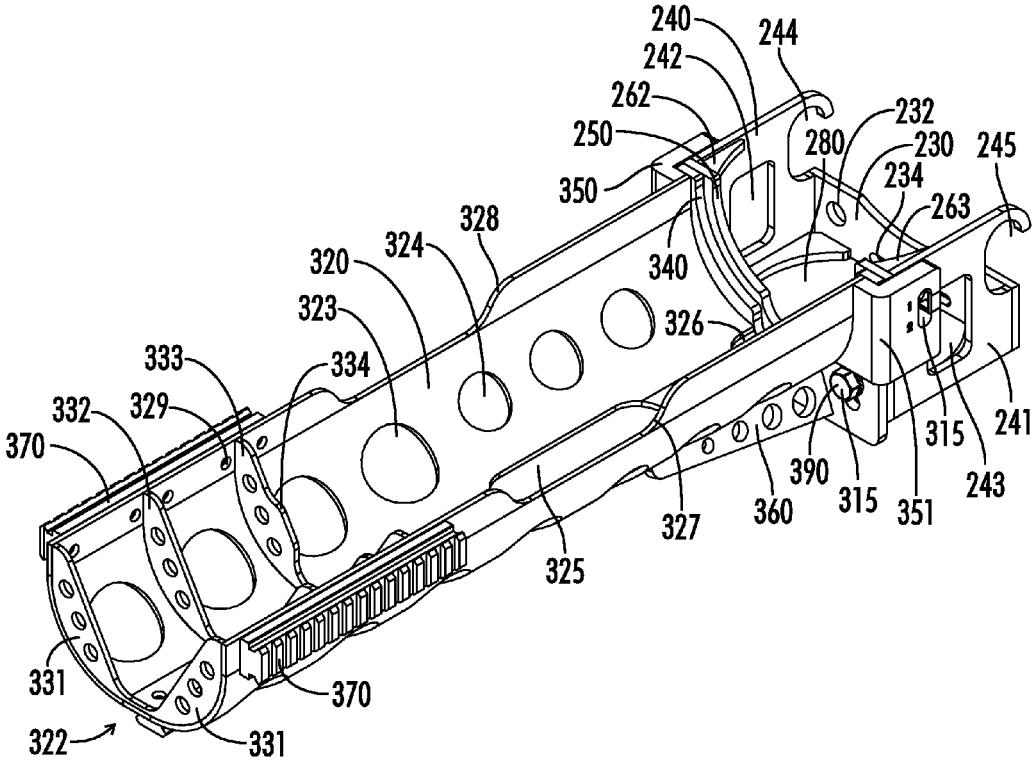
FIG. 4 is a perspective view of one embodiment of an accessory mount depicting a first and a second element attached.
Figure 5:
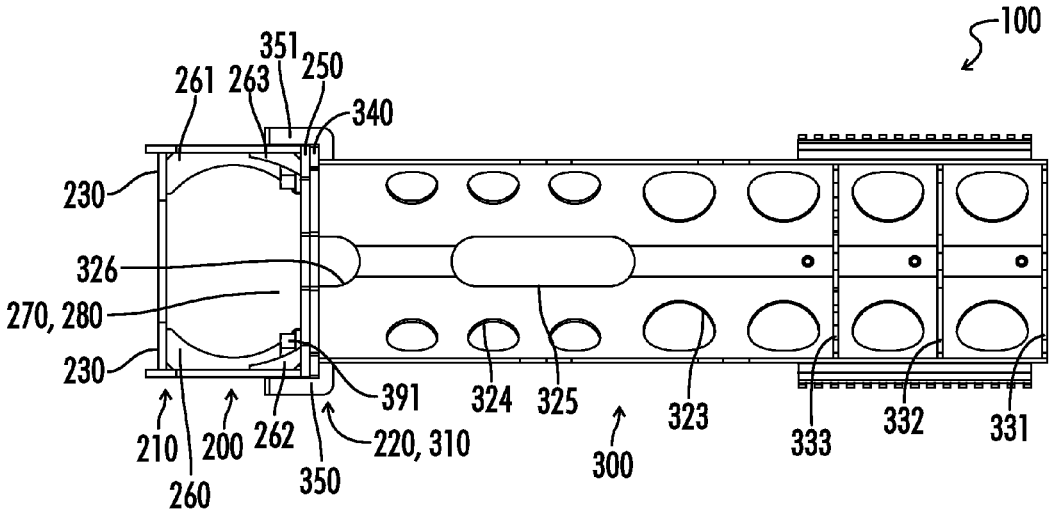
FIG. 5 is a top view of one embodiment of an accessory mount depicting a first and a second element attached.
Figure 6:
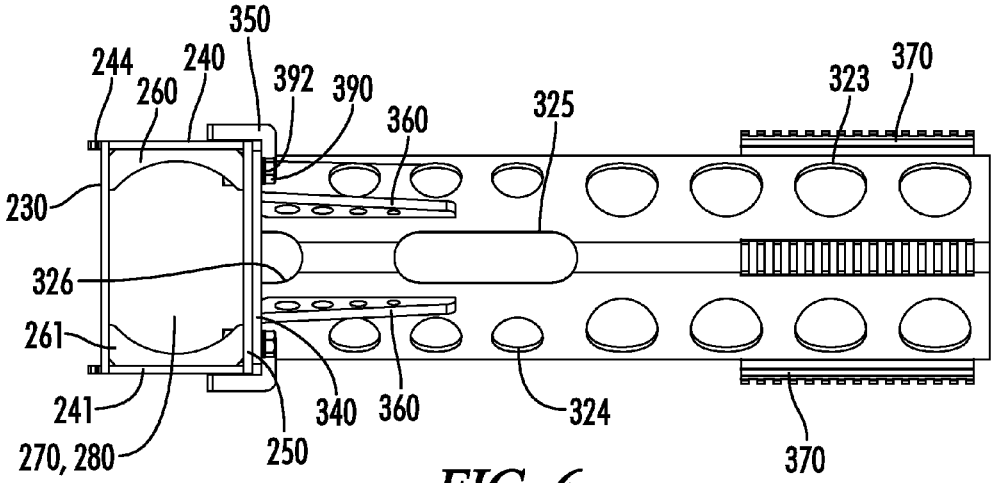
FIG. 6 is a bottom view of one embodiment of an accessory mount depicting a first and a second element attached.
Figure 7A:
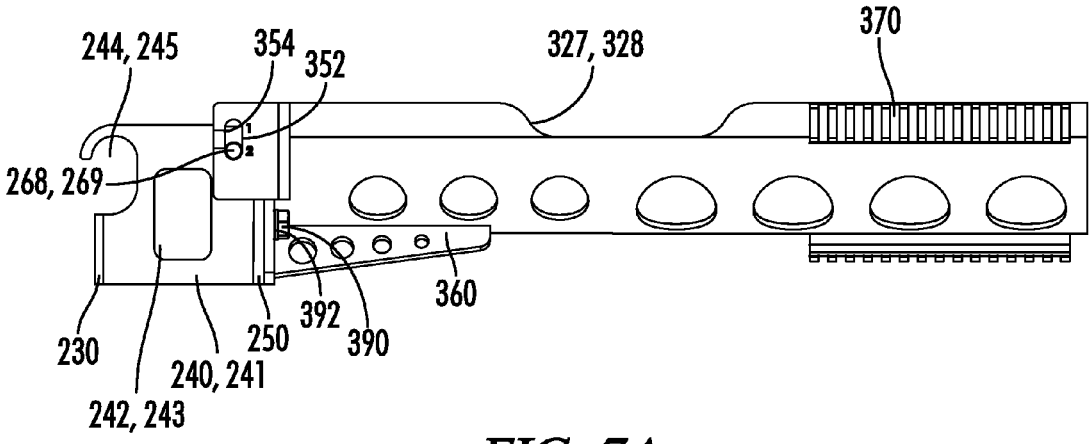
FIG. 7A is a side view of one embodiment of an accessory mount including a first and a second element attached in the upper position.
Figure 7B:
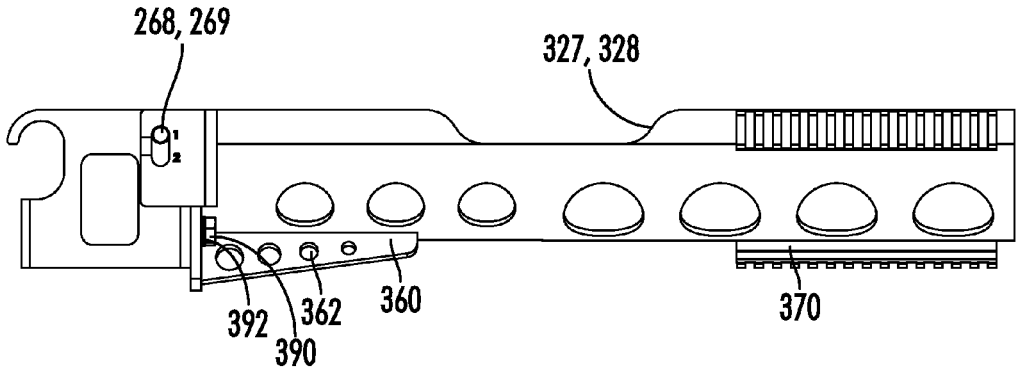
FIG. 7B is a side view of one embodiment of an accessory mount including a first and a second element attached in the lower position.
Figure 8A:
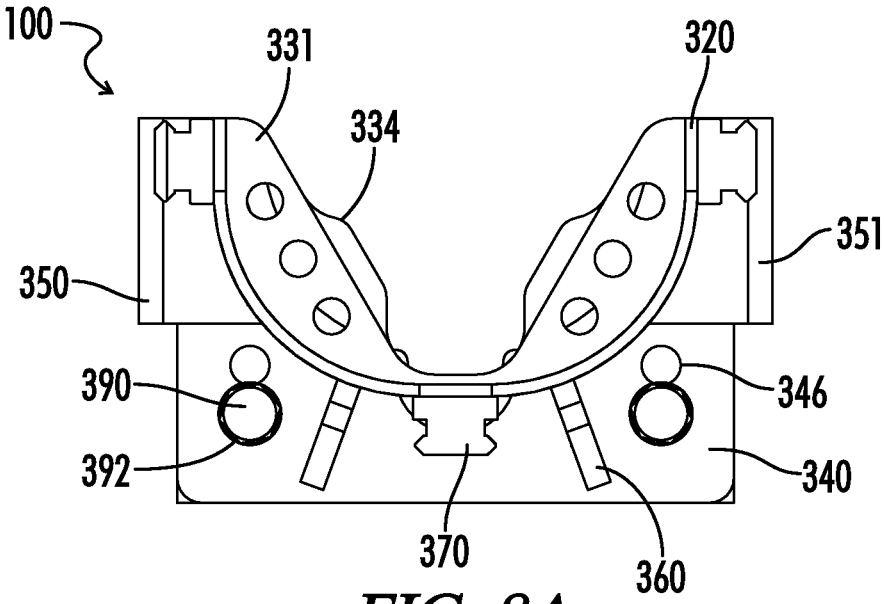
FIG. 8A is a front view of one embodiment of an accessory mount including a first and a second element attached in the upper position.
Figure 8B:
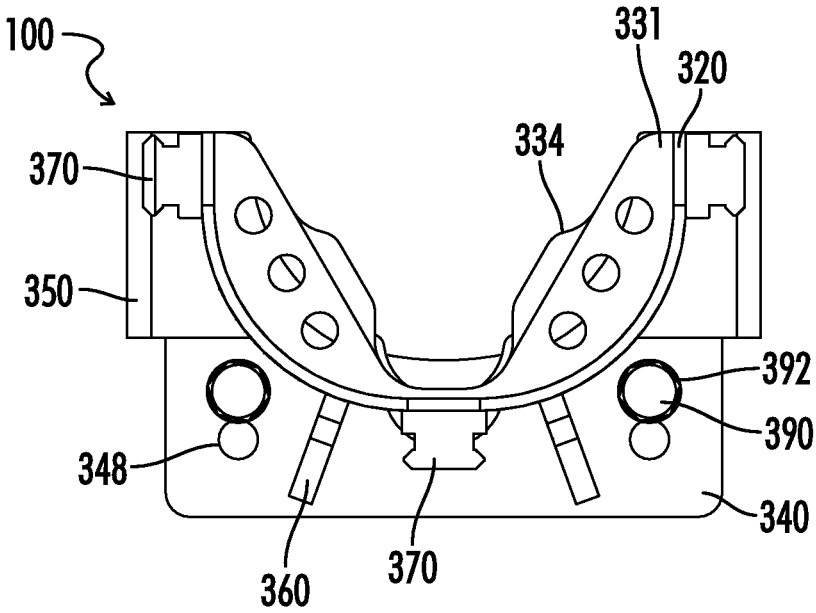
FIG. 8B is a front view of one embodiment of an accessory mount including a first and a second element attached in the lower position.
Figure 9A:
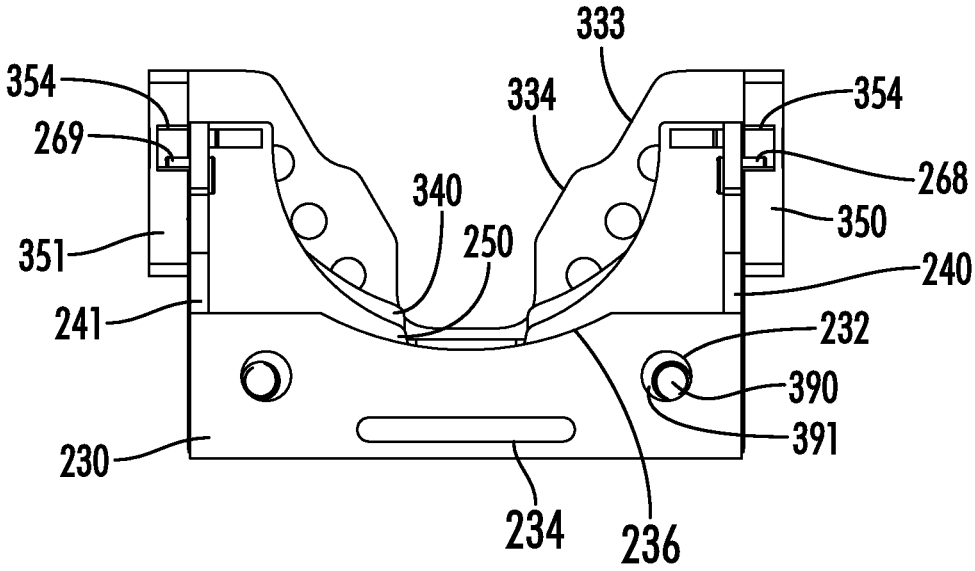
FIG. 9A is a rear view of one embodiment of an accessory mount including a first and a second element attached in the upper position.
Figure 9B:
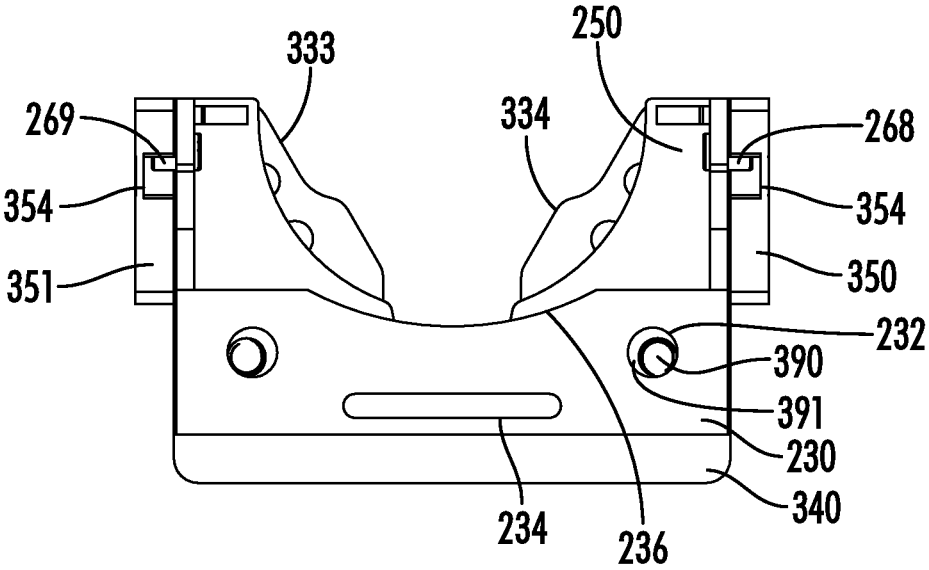
FIG. 9B is a rear view of one embodiment of an accessory mount including a first and a second element attached in the lower position.
Figure 10A:
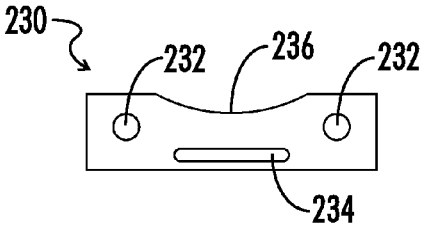
FIG. 10A is a rear view of a first element rear base plate of one embodiment.
Figure 11A:
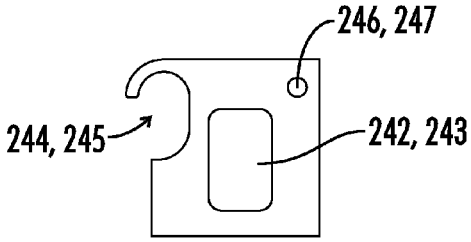
FIG. 11A is a side view of a first element side plate of one embodiment.
Figure 10B:
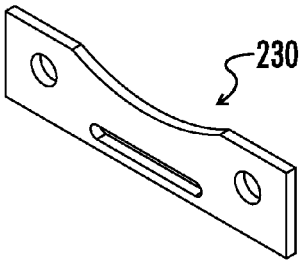
FIG. 10B is a perspective view of a first element rear base plate of one embodiment.
Figure 11B:
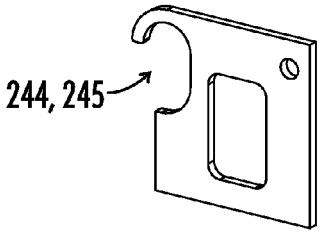
FIG. 11B is a perspective view of a first element side plate of one embodiment.
Figure 12A:
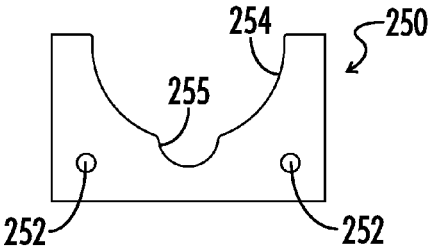
FIG. 12A is a front view of a first element front mount plate of one embodiment.
Figure 13A:
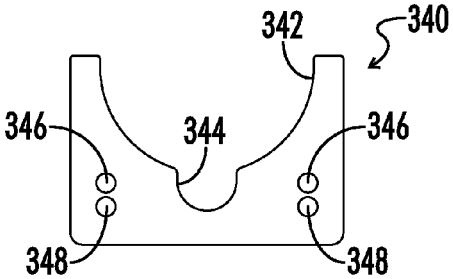
FIG. 13A is a front view of a second element accessory bar back plate of one embodiment.
Figure 12B:
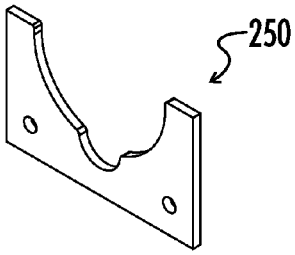
FIG. 12B is a perspective view of a first element front mount plate of one embodiment.
Figure 13B:
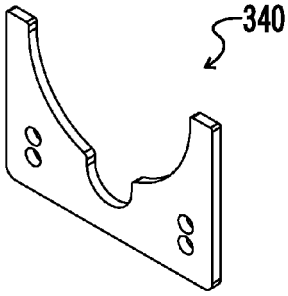
FIG. 13B is a perspective view of a second element accessory bar back plate of one embodiment.
Figure 14:
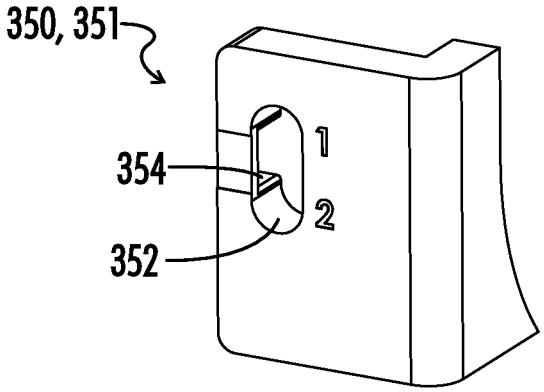
FIG. 14 is a perspective view of a second element locking plate of one embodiment.
Figure 15:
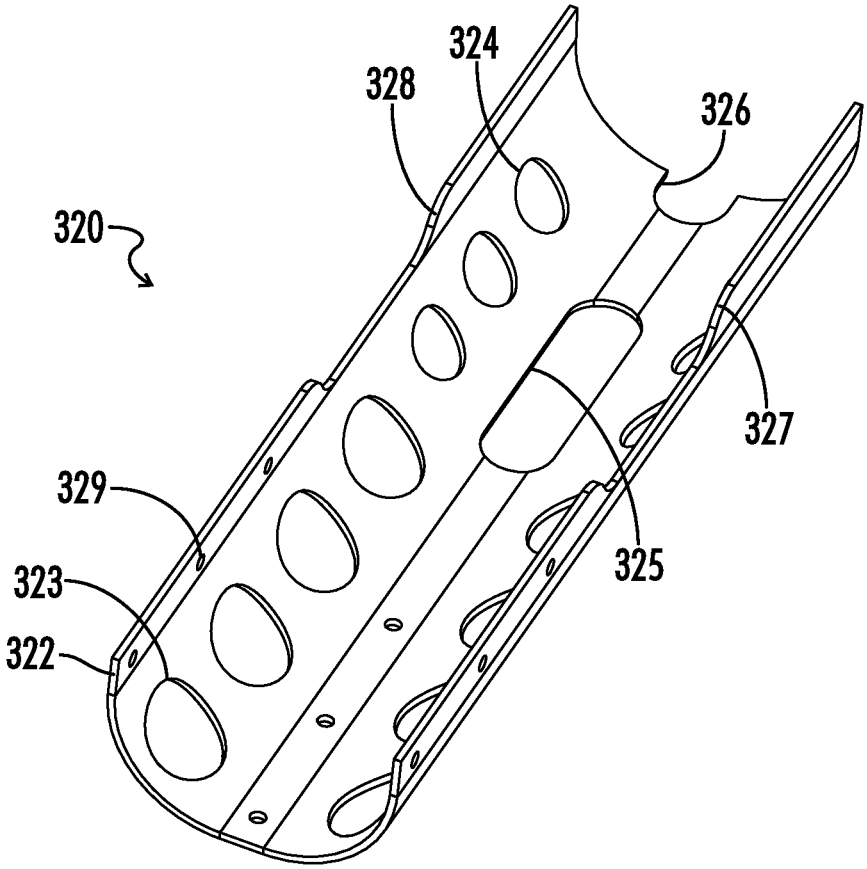
FIG. 15 is a perspective view of a second element accessory bar of one embodiment.
Figure 16A:
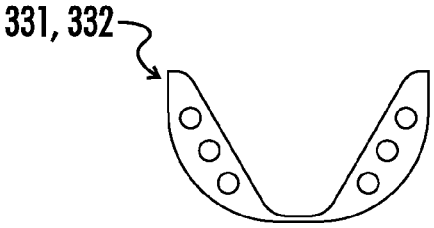
FIG. 16A is a front view of a second element accessory bar first or second V-shaped gusset of one embodiment.
Figure 17A:
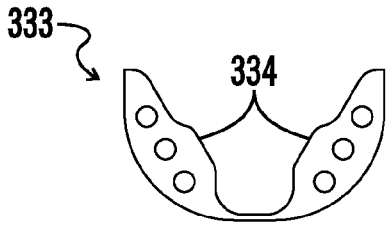
FIG. 17A is a front view of a second element accessory bar safety bump V-shaped gusset of one embodiment.
Figure 16B:
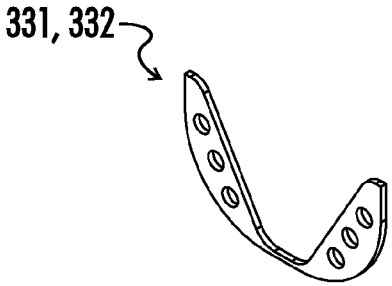
FIG. 16B is a perspective view of a second element accessory bar first or second V-shaped gusset of one embodiment.
Figure 17B:
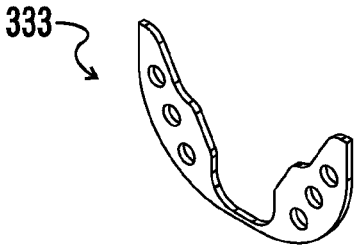
FIG. 17B is a perspective view of a second element accessory bar safety bump V-shaped gusset of one embodiment.
Figure 18:
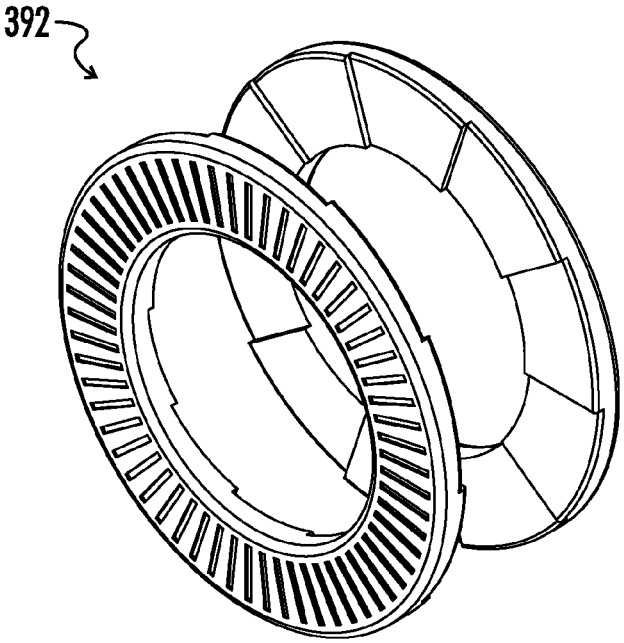
FIG. 18 is a perspective view depicting a wedge lock washer.
Figure 19:
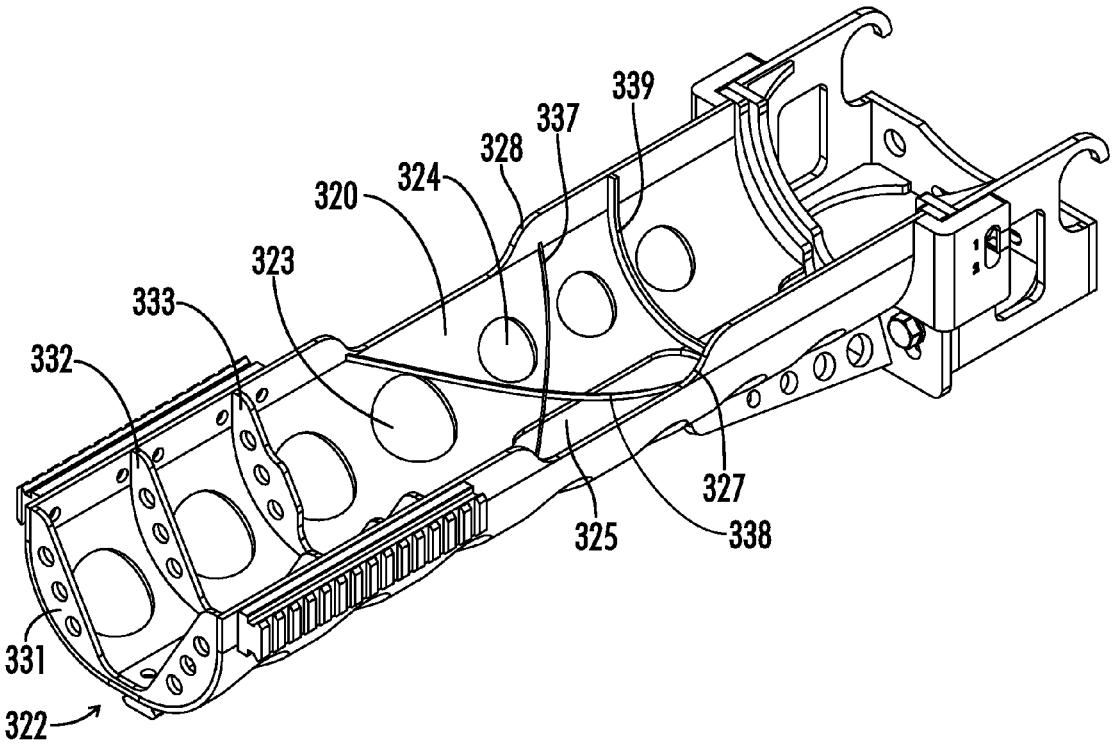
FIG. 19 is a perspective view of one embodiment of an accessory mount depicting mid and aft gussets.

One embodiment of the second element 300 structure may comprise an approximately semi-cylindrical accessory bar 320 for providing strength and rigidity wherein the approximately semi-cylindrical accessory bar 320 comprises exhaust apertures 323, 324 in lower sides of the semi-cylindrical accessory bar 320 providing removal of gas and debris from a muzzle flash 24, air flow for cooling, and lighter weight with larger apertures 323 forward and smaller apertures 324 aft, a bottom center cutout 325 disposed where the accessory bar 320 rotates closest to contacting the armor shield 30 during full downward deflection of the firearm 20, an aft mid-point cutout 326 in the accessory bar 320 for wires and connectors to pass through as the wires pass from the forward end 322 of the accessory bar 320 where the accessory mounts or rails 370 are disposed, then passing along the underside of the accessory bar 320 to the firearm mount 10, top cutouts 327, 328 on both sides of the upper portion of the accessory bar 320 providing access for firearm barrel changes, and accessory mount or rail apertures 329 disposed with the accessory bar 320 forward end 322 for attaching an accessory mount 370 at a maximum distance from the firearm mount 10. The second element 300 structure may further comprise an accessory bar back plate 340 comprising an upper semi-circular cutout 342 for clearance for the firearm 20, a lower semi-circular cutout 344 for wires and connectors to pass through, and four positioning shock bolt apertures 346, 348 wherein two upper positioning shock bolt apertures 346 align with the first element 200 two front mount plate apertures 252 when the second element is attached in an upper position and the two lower positioning shock bolt apertures 348 align with the first element 200 two front mount plate apertures 252 when the second element 300 is attached in a lower position. Two shock bolts 390 with wedge lock washers 392 secure the attachment of the bottom of the first element 200 and the second element 300. The second element 300 structure may further comprise a first or forward V-shaped gusset 331, a second or middle V-shaped gusset 332, and an aft or safety bump V-shaped gusset 333 wherein the outer shape of the V-shaped gussets match the inner contour of the accessory bar 320. The aft or safety bump V-shaped gusset 333 may further comprise a safety bump 334 disposed on the inside of the V-shaped gusset such that the firearm 20 maintains a safety clearance between the accessory bracket 100 and the barrel 22 or muzzle flash 24 when the barrel 22 or the muzzle flash 24 does not extend the full length of the accessory bracket 100. As depicted in FIG. 2, the MK19 26 is one such firearm 20 in that embodiment that does not extend to the forward end 322 of the accessory bracket 100. As illustrated in FIG. 19, additional gussets 337, 338 and 339 may be included in the mid and aft sections for strength, rigidity and endurance. Gussets may be disposed perpendicular with the axis of the approximately semi-cylindrical accessory bar 320 as depicted with gusset 339 or at an angle such that the gussets cross each other as depicted with gussets 337 and 338. The second element 300 structure may also comprise a right side locking plate 350 and a left side locking plate 351 for the accessory bar 320 wherein the right side and left side locking plates 350, 351 each comprise a vertical slot 352 such that the first element dowels 268, 269 provides visual confirmation of the upper and lower adjustment of the second element 300 in relation to the first element 200. The right side and left side locking plates 350, 351 may further comprise a horizontal slot 354 extending from the rear of the side locking plate into the vertical slot 352 for inserting and removing the first element dowels 268, 269 when attaching and removing the second element 300 in relation to the first element 200. The structure of the second element 300 right side and left side locking plates 350, 351 further align with the contour of the accessory bar 320 and attach with the accessory bar 320, wherein the right and left side locking plates 350, 351 when attached with the first element 200 lock with the first element dowels 268, 269 and provide for secure accurate locking of the top of the second element 300 with the first element 200 while also providing for an upper and lower position attachment and adjustment and provide for visual confirmation of upper and lower position. The upper position is the normal position. The lower position provides additional clearance between the firearm 20 or firearm barrel 22 and the accessory bracket 100. This need for a lower position includes but is not limited to the M2HB machine gun 25 for using a Blank Firing Adapter (BFA) and for using shorter barrel firearms such as the MK19 26. As previously described, two shock bolts 390, wedge lock washers 392, and shock bolt nuts 391 may secure the bottom attachment of the first element 200 and the second element 300. The second element 300 structure may comprise right and left support gussets 360, wherein the accessory bar 320 is attached with the accessory bar back plate 340 and the right and left side locking plates 350, 351. The support gussets 360 are attached with the accessory bar 320 and the accessory bar back plate 340 for strength and rigidity. The first or forward V-shaped gusset 331 is attached with the accessory bar 320 disposed on forward end 322 of the accessory bar 320, the safety bump V-shaped gusset 333 with safety bump 334 is attached with the accessory bar 320 disposed along the accessory bar length for maintaining safety clearance using the safety bump 334 for firearms 20 with a barrel 22 shorter than the full length of the accessory bar 320. The accessory mount or rail 370 is attached and disposed on the opposing end of the accessory bar 320 from the accessory bar back plate 340. The accessory mount or rail 370 may be a Picatinny rail that is currently used by the military with some firearms to provide a standard mounting platform for accessories 40. Other standard mounting platforms 370 may be used. Typically, due to the size and weight of the flood light accessory 42, the flood light accessory 42 is mounted on the lower side of the accessory bar 320 to enhance user visibility. The top of the second element 300 is attached using the dowel pins 268, 269 for alignment with the side locking plate 350, 351 with the first element 200 in the desired upper or lower position and two bolts 390 with wedge lock washers 392 are used to secure the bottom of the second element 300 in a desired accurate position in relation to the first element 200.

One embodiment of a structure of the second element 300 may comprise an approximately semi-cylindrical accessory bar 320, at least one accessory rail 370, for attaching at least one accessory 40, disposed on the forward end or opposing end 322 of the semi-cylindrical accessory bar 320 from the second element means for attaching with the first element 200, and the semi-cylindrical accessory bar 320 provides a length allowing full downward deflection of the firearm 20 on the firearm mount 10 with an armor shield 30 attached with the firearm mount 10, and the at least one accessory 40 attached with the at least one accessory rail 370, such that neither the accessory bar 320 or the at least one accessory 40 or the accessory bracket 100 contacts the armor shield 30 restricting downward movement of the firearm 20.

Operation of the Accessory Bracket:

1. Install the first element with the firearm mount: remove current shock bolts; hook right and left side arc cutouts over the firearm mount alignment lugs; use longer accessory bracket shock bolts and wedge lock washers for secure attachment of the first element with the firearm mount; the side, bottom or top access apertures of the right and left side plates may be used for installing bolts and tightening the bolts for securing the first element with the firearm mount.

2. Install the second element with the first element: slide the horizontal slots of the second element right and left side locking plates over the first element right and left dowel pins; raise or lower the second element to align the visual dowel pin with the second element right and left side locking plates with the upper or lower position marker and also align the shock bolt apertures for the first element with the upper or lower second element shock bolts for the desired upper or lower configuration; use accessory bracket shock bolts and wedge lock washers for secure attachment of the second element with the first element. This process may be reverse to remove the second element from the first element. The first element of the accessory bracket may be left attached with the firearm mount without the installation of the second element of the accessory bracket when desired.

3. Install the blank firing adapter: The second element is removed from the first element and the BFA is installed over the barrel back to and over the M2HB barrel support, the second element is reattached with the first element in the lower position. The procedure is reversed for removing the BFA.

4. The operator will be able to: install and change accessories; change firearms; and change barrels.

The second element normal position for most firearms 20 is the upper position or position 2. However, an example of the lower position or the position 1 use includes the M2HB for training with a Blank Firing Adapter. When the BFA fits over the barrel 22 between the barrel 2 and the second element 300 of the accessory bracket 100, there is not enough clearance for the BFA between the barrel 22 and the accessory bracket 100 in the upper position. The slightly lower position still allows for realistic training with only a slight difference in accessory alignment however a slight amount of downward deflection of the firearm may be lost. Another example of the lower position or position 1 includes the MK19 for allowance of a safety clearance between the muzzle flash 24 and the accessory bracket 100. In addition the safety bump 334 on the aft V-shaped gusset 333 ensures that the second element 300 is in the lower position for MK19 usage by restricting the firearm 20 from fitting within the accessory bracket 100 unless the lower position is selected.

Advantages/Improvements

The accessory bracket provides for interchangeability of firearms and accessories. Not only are multiple firearm and accessories operational with the accessory mount but also fast firearm, barrel, and accessory changes are capable. Due to limited attachment points with current firearm or gun mounts as well as limited space when the firearm mount is combined with an armor shield, the accessory bracket provides an innovative means for attaching accessories with the firearm mount without restricting firearm deflection due to the armor shield when engaging low, close-in targets. The accessory bracket allows for maximum firearm vertical deflection through the vertical slot of an armor shield without restricting movement. The accessory bar also protects the barrel from contact with the hard steel armor when the barrel may be hot and more pliable from firing numerous rounds of ammunition. Even with these previously mentioned constraints the accessory bracket safely provides adjustability of an upper, normal, position as well as a lower position for certain firearm configurations.

The improvements over the previous means of mounting or attaching accessories include the following: a means for attaching an accessory bracket and accessories with the firearm mount wherein the means for attaching the accessory bracket further provides a means for adjusting the height of the accessory bracket in relation to the firearm mount, or the firearm and allows for independent interchange of multiple types of firearms; a means for extension of the accessories for operator vision and full vertical movement of the firearm with firearm mount and armor shield independent of the length of the firearm; and a means for preventing injury when a firearm barrel or muzzle flash is shorter than the length of the accessory bracket; and provides a means for changing a barrel without the removal of the firearm or the accessory bracket from the firearm mount.

What is claimed is:

1. An accessory bracket for a firearm mount with a firearm, the accessory bracket comprising a first element and a second element wherein:

the first element comprises a rear base plate mountable to the firearm mount, a front mount plate, and access apertures for access to the firearm mount and the firearm and for mounting and removing the first element with the firearm mount;

the second element comprises a back plate mountable to the first element front mount plate in an upper position and a lower position thereby allowing a height of the second element in relation to the first element, the firearm mount, and the firearm to be adjusted when attaching the second element with the first element; and the second element further comprises an accessory mount to which at least one accessory may be attached, the accessory mount disposed on the opposing end of the second element from the first element and at a length from the first element allowing full downward deflection of the firearm on the firearm mount when an armor shield is attached with the firearm mount.

2. The accessory bracket of claim 1, wherein the second element further comprises safety bumps disposed on the firearm side of the second element such that when a firearm is mounted on the firearm mount the safety bumps maintain a safety clearance between the accessory bracket and the firearm barrel or muzzle flash if the firearm barrel does not extend the full length of the accessory bracket.

3. The accessory bracket of claim 1, wherein the second element further comprises apertures disposed in an area subject to hot gas and debris from a firearm mounted on the firearm mount such that the gas and debris may be exhausted away from the firearm and the accessory bracket.

4. The accessory bracket of claim 1, wherein:

the second element further comprises safety bumps disposed on the firearm side of the second element such that when a firearm is mounted on the firearm mount the safety bumps maintain a safety clearance between the accessory bracket and the firearm barrel or muzzle flash if the firearm barrel does not extend the full length of the accessory bracket; and the second element further comprises apertures disposed in an area subject to hot gas and debris from a firearm mounted on the firearm mount such that the gas and debris may be exhausted away from the firearm and the accessory bracket.

5. The accessory bracket of claim 1, wherein the second element comprises an accessory bar attached to and extending forward from the back plate and the accessory mount is attached to the accessory bar.

6. The accessory bracket of claim 5, wherein the accessory bar is semi-cylindrical.

7. The accessory bracket of claim 5, wherein the accessory bar comprises safety bumps disposed such that when a firearm is mounted on the firearm mount the safety bumps maintain a safety clearance between the accessory bracket and the firearm barrel or muzzle flash if the firearm barrel does not extend the full length of the accessory bracket.

8. The accessory bracket of claim 5, wherein the accessory bar further comprises apertures disposed in an area subject to hot gas and debris from a firearm mounted on the firearm mount such that the gas and debris may be exhausted away from the firearm and the accessory bracket.

9. The accessory bracket of claim 5, wherein:

the accessory bar comprises safety bumps disposed such that when a firearm is mounted on the firearm mount the safety bumps maintain a safety clearance between the accessory bracket and the firearm barrel or muzzle flash if the firearm barrel does not extend the full length of the accessory bracket; and the accessory bar further comprises apertures disposed in an area subject to hot gas and debris from a firearm mounted on the firearm mount such that the gas and debris may be exhausted away from the firearm and the accessory.

10. An accessory bracket comprising a first element and a second element wherein:

the structure of the first element comprises:

a rear base plate including two shock bolt apertures for mounting the first element with a firearm mount;

a right side plate including an arc cutout at a top rear portion of the side plate for hooking over a firearm mount alignment bolt wherein the side plate arc cutouts for hooking over the firearm mount alignment bolts extend aft past the rear base plate, an aperture for a dowel;

a left side plate that is the mirror of the right side plate;

a front mount plate including two front mount plate apertures, an upper semi-circular cutout for a firearm to have clearance when mounted on the firearm mount; wherein the rear base plate is attached with the right and left side plates and the front mount plate is attached with the right and left side plates; and a right and left dowel inserted in the right side dowel aperture and the left side dowel aperture approximately flush with the inside of the side plate and extending out of the aperture on the outside of the first element providing an upper mounting for the second element;

the structure of the second element comprises:

an approximately semi-cylindrical accessory bar comprising accessory mount apertures disposed on the accessory bar at a maximum distance from the firearm mount for attaching an accessory mount;

an accessory bar back plate comprising an upper semi-circular cutout for a firearm, and four accessory bar back plate apertures wherein two upper accessory bar back plate apertures align with the two front mount plate apertures when the second element is attached in an upper position and the two lower accessory bar back plate apertures align with the two front mount plate apertures when the second element is attached in a lower position;

a right side locking plate for the accessory bar and a left side locking plate for the accessory bar, the right side and left side locking plates each comprise a vertical slot cut through to the external side of the side locking plates such that the first element dowel is restricted in upper and lower movement and provides visual confirmation of the upper-lower adjustment of the second element in relation to the first element, the right side and left side locking plates further comprise a horizontal slot from the rear of the side locking plate to the vertical slot for inserting and removing the first element dowel when attaching and removing the second element in relation to the first element, the structure of the right side and left side locking plate further attach with the accessory bar, wherein the right and left side locking plates when attached with the first element lock with the first element dowel and provide for secure accurate locking of an upper portion of the second element of the accessory bar and provide for an upper-lower position adjustment and provide for visual confirmation of the upper-lower position adjustment;

accessory mounts attached with the accessory bar disposed on the opposing end of the accessory bar from the accessory back plate;

a v-shaped gusset wherein the outer shape of the v-shaped gusset match the inner contour of the accessory bar and wherein the aft v-shaped gusset further comprises a safety bump disposed on the inside of the v-shaped gusset such that a firearm maintains a safety clearance between the accessory bracket and a muzzle flash when the muzzle flash does not extend the full length of the accessory bracket; and wherein the accessory bar is attached with the accessory bar back plate and the right and left side locking plates are attached with the accessory bar, the V-shaped gusset with safety bump is attached with the accessory bar disposed for maintaining a safety clearance with the safety bump for firearms with the muzzle flash shorter than the full length of the accessory bar; and wherein the second element is attached with the first element in the desired upper-lower position and two bolts with wedge lock washers are used to secure the accurate position visually in relation to the other.

11. The accessory bracket as set forth in claim 10 wherein:

the structure of the first element front mount plate further comprises a lower semi-circular cutout for wires and connector to pass through;

the structure of the second element approximately semi-cylindrical accessory bar further comprises apertures in lower sides of the semi-cylindrical accessory bar providing exhaust of gas and debris from a muzzle flash, air flow for cooling, and lighter weight with larger apertures forward and smaller apertures aft, top cutouts on both sides of the upper portion of the accessory bar providing access for firearm barrel changes; and the structure of the second element accessory bar back plate further comprises a lower semi-circular cutout in the accessory bar back plate for wires and connector to pass through.

12. The accessory bracket as set forth in claim 11 wherein the structure of:

the first element right and left side plates further comprise a side access aperture;

the first element front mount plate further comprises nuts for attaching bolts wherein the nuts are attached in alignment with the front mount plate apertures; and the first element further comprises a right lower side gusset attached with the right side plate and the front mount plate and the rear base plate; a left lower side gusset attached with the left side plate and the front mount plate and the rear base plate; an upper front right side gusset attached with the right side plate and the front mount plate; an upper front left side gusset attached with the left side plate and the front mount plate;

the second element approximately semi-cylindrical accessory bar further comprises a bottom center cutout disposed on the accessory bar where the accessory bar rotates closest to contacting an armor shield providing the cutout for wires to deflect through, and an aft and bottom cutout disposed aft and bottom of accessory bar for wires to pass through;

the second element right side locking plate and the left side locking plate for the accessory bar further comprise a contour that aligns with the contour of the accessory bar;

the second element further comprises the accessory mounts attached with the accessory bar disposed on the opposing end of the accessory bar from the accessory back plate disposed with a lower accessory mount position, a right side accessory mount position, and a left side accessory mount position;

the second element further comprises a forward v-shaped gusset, a middle v-shaped gusset, and an aft v-shaped gusset wherein the aft v-shaped gusset further comprises the safety bump disposed on the inside of the v-shaped gusset such that the firearm maintains the safety clearance between the accessory bracket and the muzzle flash when the muzzle flash does not extend the full length of the accessory bracket; and the second element further comprises right and left support gussets, and the right and left side locking plates are attached with the accessory bar and the support gusset is attached with the accessory bar and the accessory bar back plate for strength and rigidity and the forward V-shaped gusset is attached with the accessory bar disposed on the opposing end of the accessory bar from the accessory bar back plate.

* * * * *